US005173033A

United States Patent [19]

Adahan

[11] Patent Number: 5,173,033

[45] Date of Patent: Dec. 22, 1992

[54] ONE-WAY UMBRELLA VALVE AND PORTABLE FLUID PUMPING DEVICE INCLUDING SAME

[75] Inventor: Carmeli Adahan, Jerusalem, Israel

[73] Assignee: Adahan Inc., Chicago, Ill.

[21] Appl. No.: 797,656

[22] Filed: Nov. 25, 1991

Related U.S. Application Data

[63] Continuation-in-part of Ser. No. 625,339, Dec. 11, 1990, Pat. No. 5,116,206, and Ser. No. 712,759, Jun. 10, 1991.

[51] Int. Cl.[5] ..... F16K 15/14; F04B 17/00

[52] U.S. Cl. ..... 417/234; 137/854

[58] Field of Search ..... 417/234, 415, 571; 137/854; 92/240

[56] References Cited

U.S. PATENT DOCUMENTS

| | | | |
|---|---|---|---|
| 87,728 | 3/1869 | Bellows | 137/854 |
| 3,062,601 | 11/1962 | Sadler | 92/240 |
| 4,010,946 | 3/1977 | Miller | 137/854 |
| 4,204,555 | 5/1980 | Durling | 138/854 |
| 4,414,973 | 11/1983 | Matheson | 137/854 |
| 4,513,784 | 4/1985 | Farrand | 137/854 |
| 4,540,352 | 9/1985 | Becher | 92/240 |
| 4,696,322 | 9/1987 | Knapp | 137/854 |
| 4,726,745 | 2/1988 | Adahan | 417/413 |
| 4,781,674 | 11/1988 | Redmond | 137/854 |

FOREIGN PATENT DOCUMENTS

| | | | |
|---|---|---|---|
| 127168 | 8/1982 | Japan | 137/854 |

*Primary Examiner*—Richard A. Bertsch
*Assistant Examiner*—Peter Korytnyk
*Attorney, Agent, or Firm*—Benjamin J. Barish

[57] ABSTRACT

A portable fluid pumping device includes a valve assembly having a pair of one-way umbrella valves controlling the flow of air to produce a positive pressure at one port and a negative pressure at another port. Each umbrella valve includes a valve stem having a neck received within the mounting opening, and an umbrella skirt integrally joined to the neck to overlie the valve opening. The umbrerlla skirt is relatively thin for its complete extent, and the juncture between the umbrella skirt and neck of the valve stem is of frusto-conical configuration increasing in diameter from the neck to the umbrella skirt.

14 Claims, 6 Drawing Sheets

ONE-WAY UMBRELLA VALVE AND PORTABLE FLUID PUMPING DEVICE INCLUDING SAME

RELATED APPLICATIONS

The present application is a continuation-in-part of my prior Applications Ser. No. 07/625,339 filed Dec. 11, 1990 now U.S. Pat. No. 5,116,206, issued Aug. 18, 1992 and Ser. No. 07/712,759 filed Jun. 10, 1991, which application is pending.

BACKGROUND OF THE INVENTION

The present invention relates to portable pumping devices capable of operating either as a suction pump or as a compressor. The invention is particularly applicable to the portable fluid pumping devices described in my prior U.S. Pat. No. 4,726,745, and is therefore described below with respect to this type of device.

My U.S. Pat. No. 4,726,745 discloses a portable pumping device particularly useful as a medical suction pump for drawing off waste fluids. The pumping device described in that patent is now in production, but one of its drawbacks is that it requires a rolling diaphragm between the piston and cylinder. Rolling diaphragms, however, degrade with time and deform under pressure to introduce "dead" piston travel which stretches the diaphragm without displacing air. Such pumps, therefore, require frequent replacement of the diaphragm.

In addition, pumps of this type are extremely noisy at the exhaust end when operating as a suction pump, and at the air-intake end when operated as a compressor. One source for such noise is the one-way umbrella valves commonly used in such pumps. Thus, the common umbrella valve construction includes a dome-shaped umbrella skirt integrally joined to the neck of a stem received within a mounting opening formed in a wall, which wall is also formed with the valve opening covered by the umbrella skirt. Such umbrella valves require high seating forces which generate a high pitch noise. In addition, such umbrella valves are difficult to produce by injection molding and require high precision in the mounting opening.

OBJECTS AND SUMMARY OF THE PRESENT INVENTION

One object of the invention of the present application is to provide a one-way umbrella valve of a novel construction which provides a number of advantage over the conventional one-way umbrella valve.

Another object of the invention is to provide a portable fluid pumping device including the novel one-way umbrella valve.

According to one aspect of the present invention, there is provided a one-way umbrella valve for controlling the flow of a fluid through a valve opening in a wall, comprising: a valve stem having a neck received within a mounting opening in the wall, and an umbrella skirt integrally joined to said neck to overlie the valve opening on one side of the wall; the juncture between the umbrella skirt and neck of the valve stem being of frusto-conical configuration increasing in diameter from the neck to the umbrella skirt. The umbrella skirt is relatively thin for its complete extent. In addition, one side of the wall in which the valve is mounted is formed with a cavity of frusto-conical configuration with the mounting opening at the center of the cavity and the valve opening adjacent to the outer periphery of the cavity.

According to further features in the preferred embodiment of the invention described below, the umbrella skirt has a relatively flat outer surface in its normal condition. Further, the umbrella skirt has an inner tapered surface which defines, with its flat outer surface, a frusto-conical skirt having a substantially larger conical angle than that of the frusto-conical neck.

According to further features in the described preferred embodiment, the conical angle of the frusto-conical cavity is smaller than that of the frusto-conical skirt but larger than that of the frusto-conical neck.

According to still further features in the described preferred embodiment, the stem includes an end section joined to its neck and to be severed from its neck after the umbrella valve is applied to the wall. The juncture of the end section of the neck has a cross-sectional area less than one-half that of the neck, such that after the neck is received within the mounting opening in the wall, the end section of the neck may be tensioned to press the umbrella skirt against the one side of the wall over the valve opening, to stretch the neck, and to reduce its diameter until it protrudes substantially through the opening and breaks at its juncture with the end section of the stem, whereupon the protruding portion of the neck contracts in length and increases in diameter to form a bulge for securely retaining the umbrella skirt in the mounting opening with the umbrella skirt tensioned against the one side of the wall.

According to another aspect of the present invention, there is provided a one-way umbrella valve for controlling the flow of a fluid through a valve opening in a wall, comprising a valve stem having a neck received within a mounting opening in the wall, and an umbrella skirt integrally joined to the neck to overlie the valve opening on one side of the wall. The juncture between the umbrella skirt and neck of the valve stem is of frusto-conical configuration increasing in diameter from the neck to the umbrella skirt. The umbrella skirt is relatively thin for its complete extent. The stem includes an end section joined to its neck and to be severed from its neck after the umbrella valve is applied to the wall. The juncture of the end section of the neck has a cross-sectional area less than one-half that of the neck, such that after the neck is received within the mounting opening in the wall, the main section of the neck may be tensioned to press the umbrella skirt against the one side of the wall over the valve opening, to stretch the neck, and to reduce its diameter until it protrudes substantially through the opening and breaks at its juncture with the end section of the stem, whereupon the protruding portion of the neck contracts in length and increases in diameter to form a bulge for securely retaining the umbrella skirt in the mounting opening with the umbrella skirt tensioned against the one side of the wall.

As will be described more particularly below, umbrella valves constructed in accordance with the foregoing features produce, particularly when used in portable fluid pumping devices, substantially less noise than such devices using conventional one-way valves. Moreover, the foregoing features permit umbrella valves to be produced more simply, to be applied more conveniently, and to require substantially less precision in the mounting openings, than the conventional umbrella valve construction particularly when used in portable fluid pumping devices.

According to another aspect of the invention, there is provided a portable fluid pumping device including one-way umbrella valves of the foregoing construction.

According to a still further aspect of the present invention, there is provided portable fluid pumping devices in which the piston head is integrally formed with the piston stem of rigid plastic material and decreases in diameter at its outer periphery to define a thin walled flexible seal at its outer periphery.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

The Embodiment of FIGS. 1-5

Figure 1:
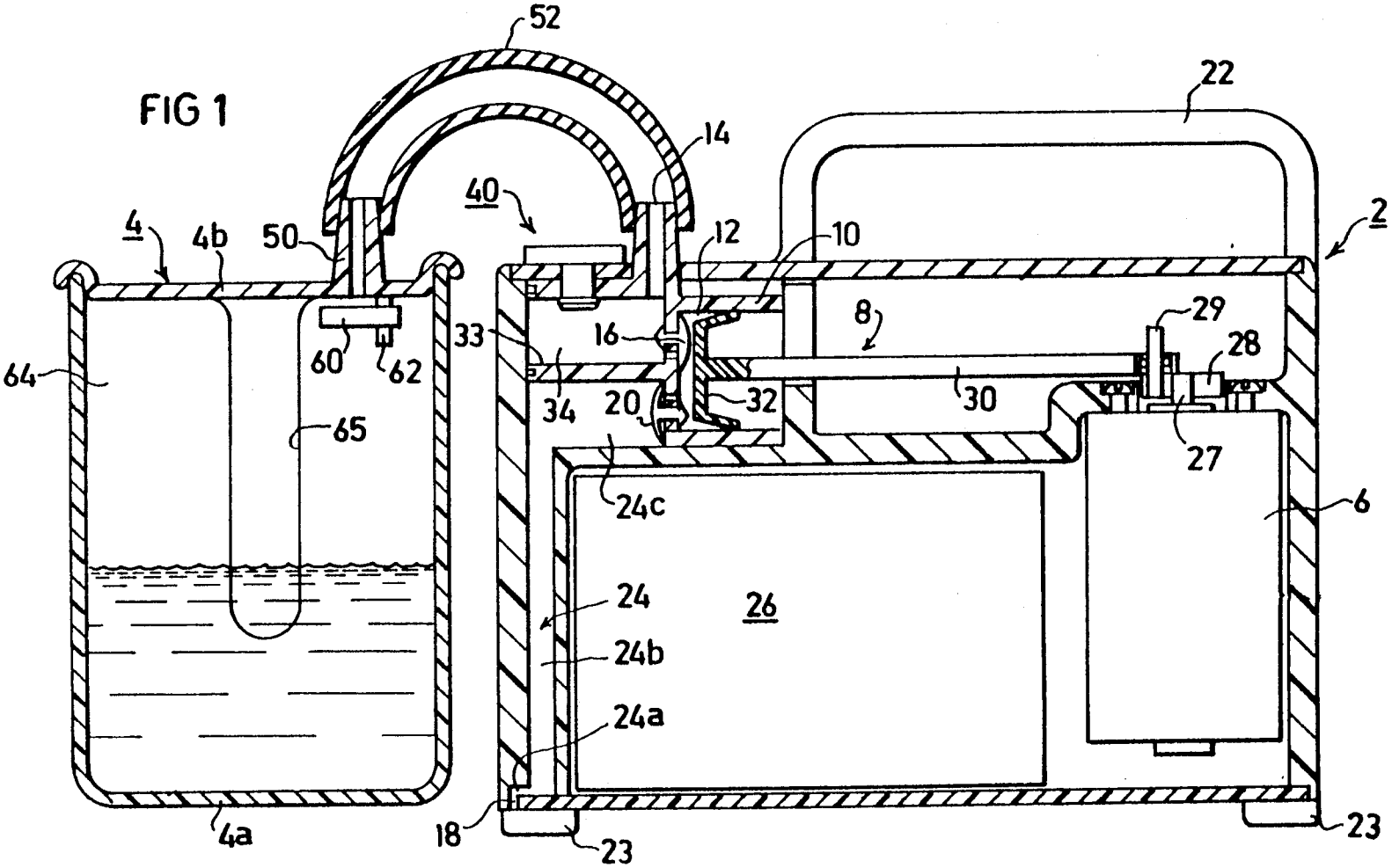
FIG. 1 is a longitudinal sectional view illustrating one form of portable fluid pumping device including an attached collection container constructed in accordance with the present invention.

The pumping device illustrated in FIGS. 1-5 is intended for use as a portable suction pump for medical applications, such as for drawing off waste liquids into a collection container to be detachably carried by the pump. The illustrated suction pump includes a pump housing 2 and a detachable liquid collection container 4 into which the liquids are drawn.

The suction pump is operated by an electric motor 6 in the pump housing 2. Motor 6 reciprocates a piston 8 within a cylinder 10 defining a pumping chamber 12. It will be seen that rightward reciprocations of piston 8 produces a negative pressure within chamber 12, whereas leftward reciprocations of the piston produce a positive pressure in that chamber. Chamber 12 is in a passageway which communciates with a first port 14 via a one-way umbrella valve 16; valve 16 opens during the rightward reciprocations of piston 8 to produce a negative pressure at port 14. Chamber 12 also communciates with a second port 18 via a second one-way umbrella valve 20 which opens during the leftward reciprocations of piston 8 to produce a positive pressure at port 18.

The illustrated pumping device is designed for convenient portability. Accordingly, the pump housing 2 includes a handle 22 and a plurality of feet 23 for supporting the housing on a flat supporting surface with the bottom of the housing raised above the surface. The pump housing 2 further includes a compartment for holding a battery 26 powering the motor 6.

The positive-pressure port 18 is located in the bottom wall of the pump housing 2, and is connected to its one-way valve 20 via a passageway 24 which includes three bends 24*a*, 24*b*, 24*c*. Most of the noise generated by suction pumps is at the exhaust end, and it has been found that this construction substantially reduces the level of the noise produced during the operation of the pump.

Motor 6 which drives piston 8 includes an output rotary shaft 27 which receives an eccentric bearing 28 coupled by pin 29 to stem 30 of piston 8. Stem 30 is fixed to piston head 32 reciprocatable in cylinder 10. The axis Am (FIG. 2) of motor 6 is offset somewhat from the axis Ac of the cylinder 10. The eccentric bearing 28 is freely received (i.e., without fasteners) around the rotary drive shaft 27 of the motor 6.

Figure 3:
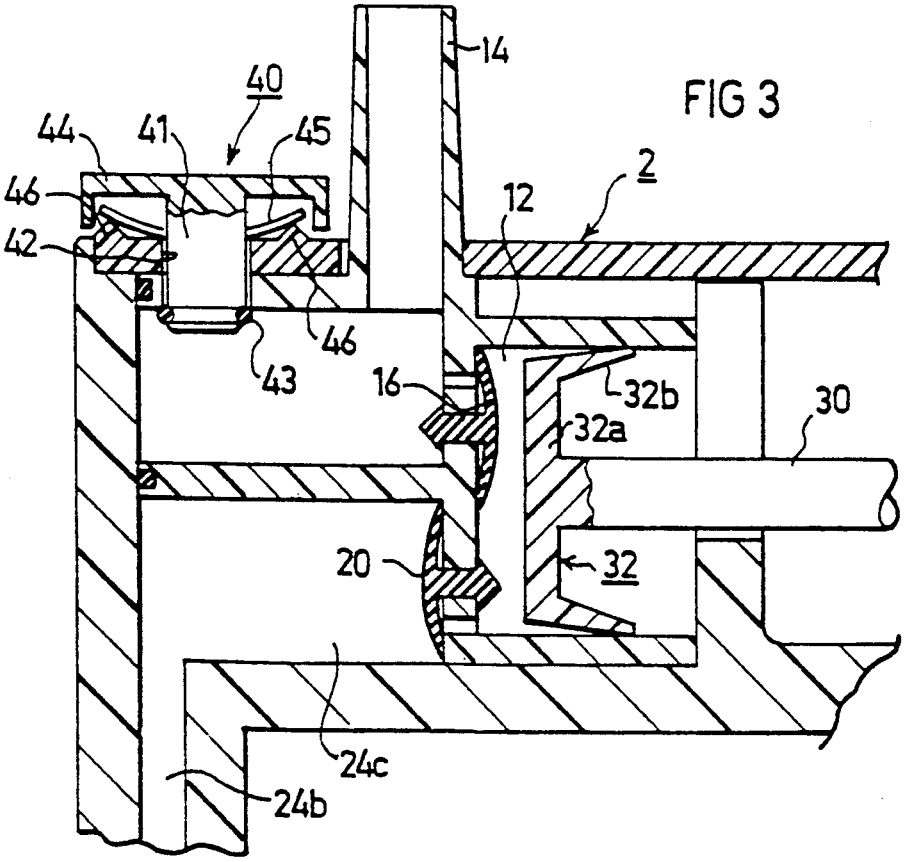
FIG. 3 is an enlarged fragmentary view of a portion of the pumping device of FIG. 1.

As shown particularly in FIG. 3, piston head 32 is formed with a central rigid section 32*a* of smaller diameter than the inner diameter of cylinder 10, and with a peripheral flexible section 32*b* slidably engageable with the side wall of the cylinder during the reciprocations of the piston. The peripheral flexible section 32*b* is of frusto-conical configuration, and is of smaller thickness than the central rigid section 32*a*. Preferably, section 32*b* continuously decreases in thickness to its outer tip, so as to form a flexible lip engageable with the inner face of cylinder 10 during the reciprocations of the piston.

It has been found that in such a construction, the outer peripheral section 32*b* of the piston head 32 forms an expansible lip producing an effective sliding seal with the cylinder 10, and thereby obviates the need for a rolling diaphragm or other separate seal. In this construction, the piston 30 "wobbles" during its reciprocations by motor 6 and eccentric bearing 28, and the free mounting of the eccentric bearing to the motor shaft, together with the offset between the motor axis Am and cylinder Ac, keeps the piston aligned with the cylinder particularly during the compression stroke when the forces on the piston are greatest.

Small airpump pistons generally utilize an annular seal to conform to the shape of the cylinder as the piston wobbles. The shape of the seal alternates between a circle and an elipse through the reciprocation cycle. The seal is usually a separate flexible member which conforms to the cylinder without great interference forces, thus keeping the friction low. The piston itself has to be of a thick section to withstand the loads of the pressurized gas; for example, in the present case the pressure may be as high as 30 PSI.

In the piston illustrated in FIG. 3 of the drawings, however, the piston head 32*a* is integrally formed with the radially-extending piston stem 30 of rigid plastic material, such as an acetal resin, which can withstand the high loading of the pressurized air. However, the piston head 32*a* decreases in thickness and is turned axially at its outer periphery to define a thin, flexible frusto-conical skirt or seal 32*b* at its outer periphery. For example, when using an acetal resin, the peripheral flexible skirt 32*b* of the piston head 32*a* having a thickness of 0.2 mm to 0.3 mm has been found to provide excellent conformity to the cylinder, low frictional force because of the thin wall construction, and a very low friction seal because of the lubricating qualities of the acetal resin. Also, the increased pressure during operation causes the seal to expand thereby enhancing the seal. Thus, the thin wall construction of the piston skirt enables the complete piston head and stem to be constructed of very hard material and yet produces a flexible seal around its periphery.

The assembly of the two one-way valves 16, 20 includes a partition 33 which divides this portion of the passageway between cylinder 10 and the two ports 14, 18, into the previously-mentioned positive-pressure section 24 leading to port 18, and a negative-pressure section or chamber 34 leading to port 14. Chamber 34 includes a presettable device, generally designated 40, which enables presetting the vacuum produced at the negative-pressure port 14.

Figure 3A:
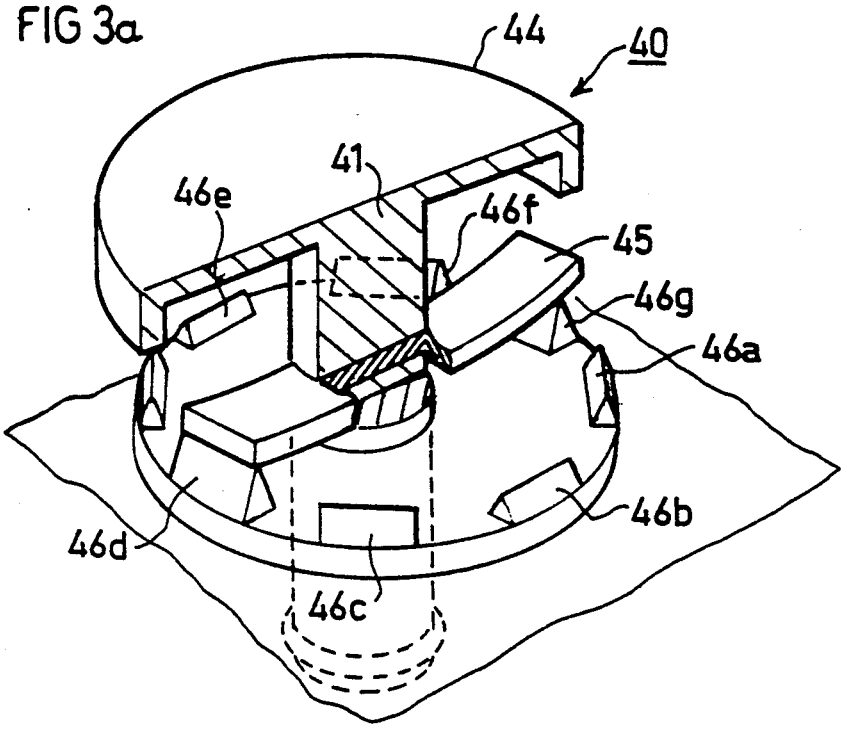
FIG. 3*a* is an enlarged fragmentary view of a part of FIG. 3.

Presettable device 40, as more particularly illustrated in FIGS. 3 and 3*a*, comprises a cylindrical plug 41 slidably and rotatably movable within a cylindrical opening 42 formed in the pump housing 2. The inner end of plug 41 carries a sealing ring 43 normally engageable with the inner face of housing 2. The outer end of the plug carries an enlarged knob 44 permitting the plug to be manually rotated within opening 42.

The presettable device 40 further includes an arched, rectangular leaf spring 45 passing through an opening in the outer end of plug 41 so as to be rotatable with the plug. The outer ends of leaf spring 45 engage a projecting formation 46 formed in the outer surface of the pump housing 2 around opening 42. Projecting formation 46 is in the form of a plurality of discrete projections 46*a*–46*g* of different heights arranged in a circular array around opening 42.

It will thus be seen that the height of the projections 46 engaging the ends of the leaf spring 45 will determine the outward force applied by the leaf spring to plug 41, and therefore the degree of vacuum required to be produced within chamber 34 (FIG. 1) in order to overcome this force and to pull the plug inwardly to unseat seal 43. Accordingly, so long as the vacuum within chamber 34 is less than that preselected by the rotary position of plug 41, seal 43 will be firmly pressed by the leaf spring 45 against the inner surface of the housing to seal opening 42. However, whenever the vacuum exceeds the preset value, the vacuum will draw plug 41 inwardly, against the force of the leaf spring 45, to unseat seal 43, and thereby to release the vacuum within chamber 34 until the vacuum reaches the level preset by plug 41.

The negative-pressure port 14 of the pump housing 2 is connected to a negative-pressure port 50 (FIG. 1) in the liquid collection container 4 via a flexible tube 52. As shown particularly in FIG. 4, liquid collection container 4 includes a second negative-pressure port 54 adapted to be connected to an external object, e.g., for drawing waste liquids from a person by suction.

The liquid collection container 4 further includes a shut-off valve 60 effective to shut-off port 50 of the collection container 4 from port 14 of the pump housing 10 in case the liquid accumulated within container 4 rises to the level of port 50. This is to prevent liquid from being drawn into the pump when the collection container is full. Shut-off valve 60 is in the form of a strip of elastomeric material mounted at one end in cantilever fashion to the inner face of the collection container 4 by means of a stem 62. The opposite end of elastomeric strip 60 underlies port 50 so that when container 4 becomes full of liquid, the liquid will displace the opposite end of the elastomeric strip against the wall of the container to thereby close port 50, and thereby prevent liquid from being drawn into the pump housing 2.

The illustrated construction has been found to be more reliable than the common float type shut-off valve. Thus, the common float shut-off valve is influenced somewhat by gravity when the container is tilted on the side, and therefore could shut-off prematurely. However, the illustrated cantilever-mounted elastomeric strip is not so affected by gravity. Accordingly, this construction is not only simpler and less costly, but is also more reliable particularly when the collection container is tilted.

The liquid collection container 4 is made of a main section 4*a* and a cover section 4*b*, both of injection-molded plstic material. The main section 4*a* is molded with a plurality of partitions 64 extending for the complete width and complete height of the container, so as to divide its interior into a plurality of compartments 64*a*, 64*b*, 64*c*. In such a construction, the partitions 64 reinforce the container and thereby enable it to be constructed of relatively thin walls. Each of the partitions 64, however, is formed with an elongated slot 65 starting from its upper end but terminating short of its lower end, to enable the liquid accumulating in the container to flow from one compartment to the other until all the compartments are full.

Figure 2:
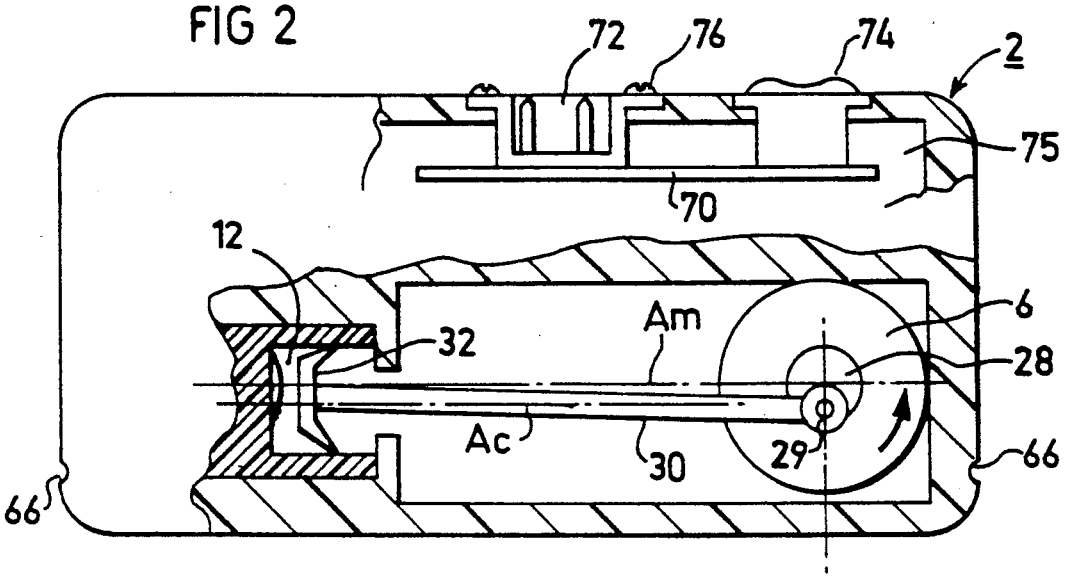
FIG. 2 is a top plan view partly in section more particularly illustrating the construction of the pumping device of FIG. 1.
Figure 5:
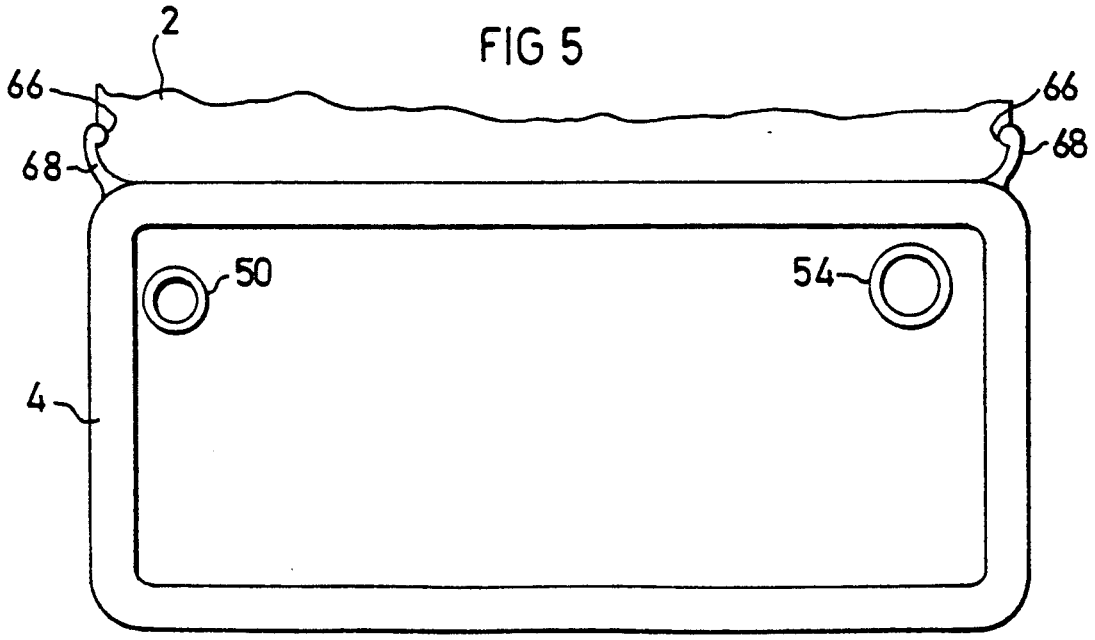
FIG. 5 is a top plan view of the collection container of FIG. 4 with a fragment of the pump housing illustrating how the collection container may be detachably secured thereto.

Pump housing 2 is further formed with a pair of recesses 66 extending along its opposite end walls adjacent one side wall of the housing, and for the height of the housing, as shown particularly in FIGS. 2 and 5. These recesses 66 are adapted to receive a pair of projecting ribs 68 (FIG. 5) formed in the collection container housing 4, to enable the collection container to be conveniently attached to and detached from the pump housing. Thus, ribs 68 may be flexible with rounded tips to facilitate applying the collection container 4 from the side of the pump housing with a snap-fit. Alternatively, ribs 68 may be rigid, whereupon the collection container would be applied by inserting it endwise and sliding it down into alignment with the pump housing.

The electronic circuitry for controlling motor 6 is contained on a printed circuit board 70 received within the pump housing 2, as shown particularly in FIG. 2. Printed circuit board 70 also includes a power socket 72 for connecting the pump to an external power supply mains, and a power switch 74 of the rocker type for turning the electric motor on and off. Printed circuit board 70, containing both socket 72 and the power switch 74, thus forms a small compact unit which may be conveniently inserted within a compartment 75 formed in the pump housing 2 for this purpose and secured therein by fasteners 76.

The manner of using the vacuum pump illustrated in FIGS. 1–4 will now be described.

The pump may be preset for any preselected vacuum by rotating knob 44 of plug 41 to cause the flat leaf spring 45 to engage the appropriate projection 46*a*–46*f* (FIG. 3*a*), according to the maximum vacuum desired to be produced by the pump. The negative-pressure port 14 of the pump is then connected by flexible tube 52 (FIG. 1) to the negative-pressure port 50 of the collection container 4; and negative-pressure port 54 of the collection container is connected to the object to be subjected to the vacuum.

Motor 6 is then energized to cause piston 8 to reciprocate within cylinder 10. During the reciprocations of piston head 32 within cylinder 10, umbrella valve 16 produces a negative pressure at port 14, which is applied to the object via tube 52 and collection container 4, whereas umbrella valve 20 produces a positive pressure at port 14, to exhuast the air to the atmosphere. As described earlier, the noise produced by the exhaustion of the air is substantially reduced because port 18 is located in the bottom wall of the pump housing 2, the latter being raised by feet 24, and also because port 18 is connected to its respective valve by passageway 24 formed with a plurality of bends.

During the operation of the pump, if the vacuum produced exceeds the maximum value preset by relief valve 40, plug 41 of the latter valve will move inwardly to unseat its seal 43 from the inner face of housing 2, thereby releasing some of the vacuum within the housing until the preset maximum vacuum is restored. If the liquid drawn into the collection container 4 rises to the level of port 50, the elastomeric strip 60 will move upwardly to close port 50 and thereby to prevent liquid in container 4 from being drawn into the pump housing.

Figure 6:
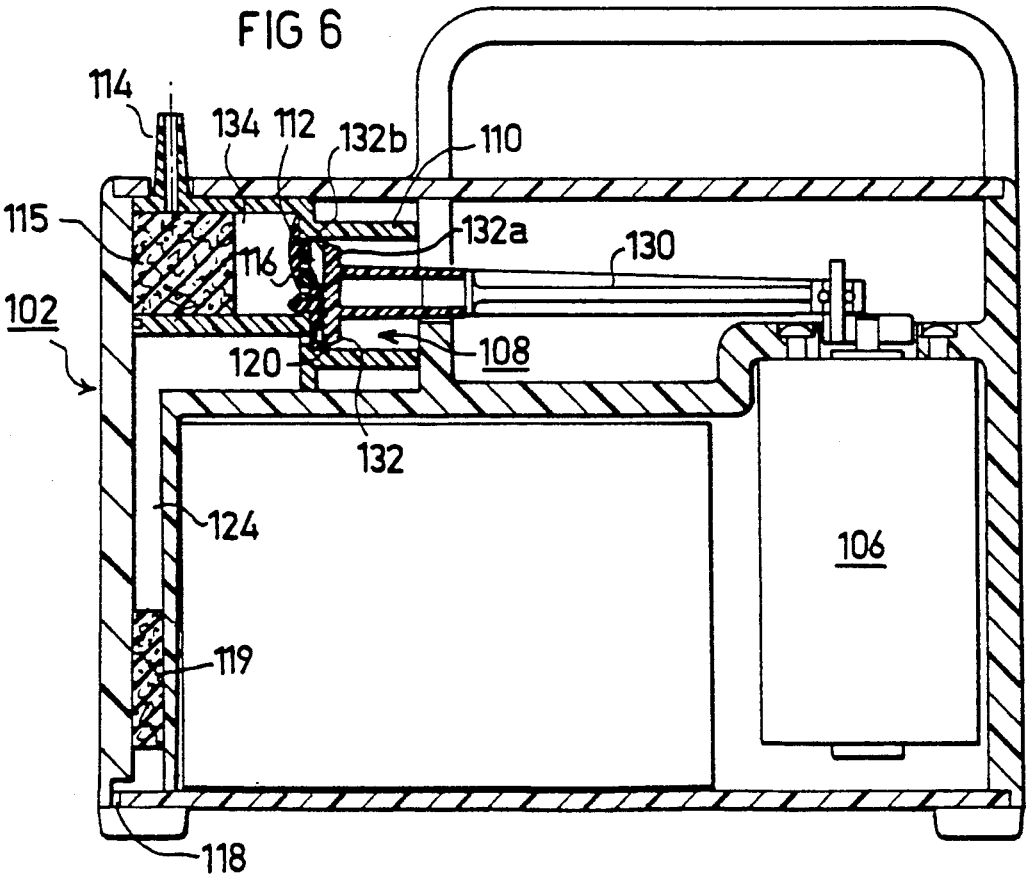
FIG. 6 is a sectional view illustrating the pumping device of FIG. 1 but slightly modified to produce a positive pressure at the outlet port.
Figure 4:
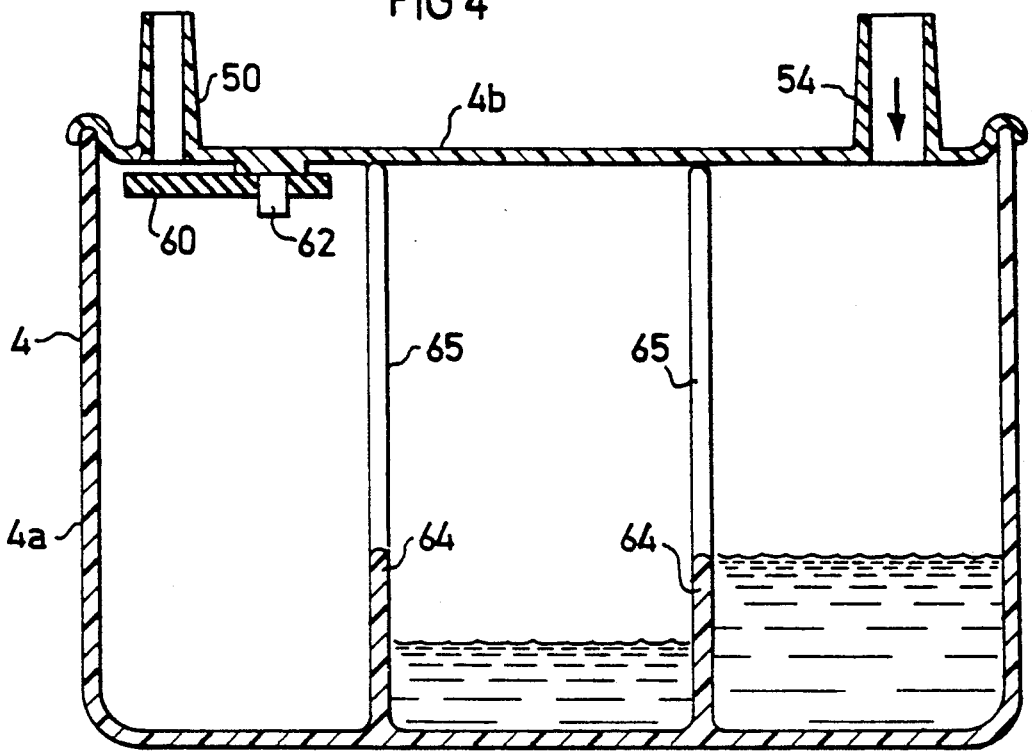
FIG. 4 is a longitudinal sectional view through the collection container attached to the pumping device of FIG. 1.

The Embodiment of FIG. 6

The pump illustrated in FIG. 6 is of basically the same construction as that described with respect to FIGS. 1-5, except that the pump is used as a compressor. Thus, it produces a positive pressure at the output port, therein designated 114, and draws air via an inlet port 118 at the bottom of the housing. For this purpose, the two umbrella valves are reversed. Thus, umbrella valve 116, communicating with port 114, is oriented to permit air to flow only from the pumping chamber 112 outwardly into chamber 134 communicating with the outlet port 114; similarly, valve 120 is oriented to permit air to flow only from the inlet passageway 124 connecting port 118 to the pumping chamber 112.

The positive-pressure outlet port 114 may be connected to a nebulizer, vaporizer, or the like, operated by the flow of pressurized air from port 114. In this construction, a filter body 115 is included within chamber 134 leading to the positive-pressure port 114 to filter the outletted air and also to muffle the noise produced during the operation of the pump. Another filter 119 is included in passageway 124 leading from the inlet port 118, also to filter the inletted air and to muffle the noise produced by the flow of air through passageway 124.

In the construction illustrated in FIG. 6, the drive may also be the same as described above with respect to FIGS. 1-5, including a motor 106 driving a piston 108 within a cylinder 110 to produce positive and negative pressures within pumping chamber 112 during the reciprocations of the piston. The piston stem 130 and piston head 132 are of the same construction as described above, including a central rigid section **132*a* of smaller diameter than the inner diameter of the cylinder 110, and an outer flexible rim 132*b* of frusto-conical configuration slidably engageable with the inner face of the cylinder. In this construction, however, the frusto-conical flexible rim 132*b* is turned inwardly towards the pumping chamber 112, rather than away from the pumping chamber as described above with respect to FIGS. 1-5**.

In all other repects, the construction of the positive-pressure pump illustrated in FIG. 6 is substantially the same as described above with respect to the negative-pressure pump illustrated in FIGS. 1-5.

Figure 7:
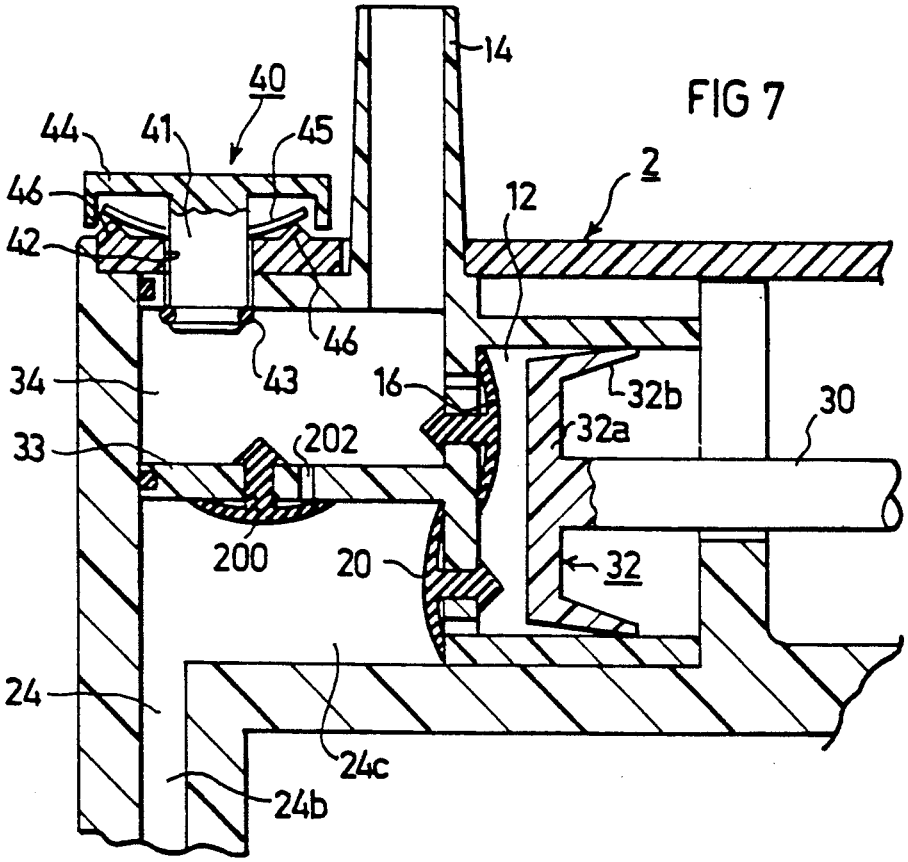
FIG. 7 is a view, similar to that of FIG. 3, but illustrating a variation in the construction of the pumping device.

The Variation of FIG. 7

FIG. 7 illustrates a variation which includes a one-way umbrella valve 200 in the partition 33 between the vacuum chamber 34 communicating with the negative-pressure port 14, and passageway 24 communicating with the positive-pressure port (18, FIG. 1). Umbrella valve 200 controls a valve opening 202 in partition 33 such that the valve permits a flow from vacuum chamber 34 to passageway 24 (and thereby to the atmosphere) during the return (or compression) strokes of piston 30. Thus, during the suction strokes (when piston 30 moves rightwardly), suction is applied via valve 16, chamber 34, and negative-pressure port 14, to draw fluid through the tube (52, FIG. 1) connected to that port, while valve 200 closes chamber 34 from the atmosphere (via passageway 24); and during the compression strokes (when piston 30 moves leftwardly), the air is exhausted via valve 20 and passageway 24 to the atmosphere. However, the momentum of the fluid flowing through the tube (52) opens valve 200 to vent chamber 34 to the atmosphere (via pasageway 24), thereby maintaining a flow during the compression (return) strokes of the piston.

The variation illustrated in FIG. 7 has been found to increase the flow from the suction chamber 34, and also to reduce the level of the noise produced by the device when operating.

Figure 8:
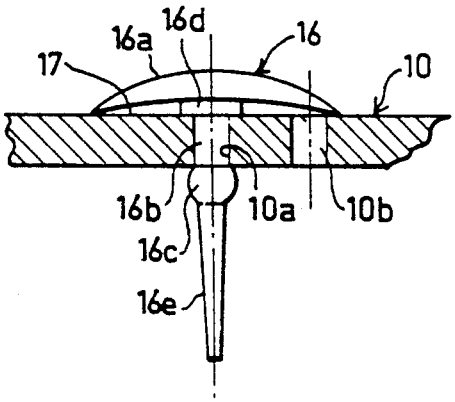
FIG 8 (PRIOR ART)
FIG. 8 illustrates a conventional (prior art) construction of a one-way umbrella valve, FIG. 8*a* illustrating its condition when the valve is open.
Figure 9:
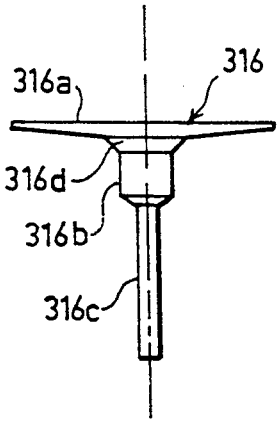
FIG. 9 illustrates the construction of an improved one-way umbrella valve in accordance with the present invention, FIG. 9*a* illustrating the manner of applying the valve, and FIG. 9*b* illustrating its condition when the valve is open and the stem severed.

Improved Umbrella Valve Construction (FIGS. 8 and 9)

Figure 8A:
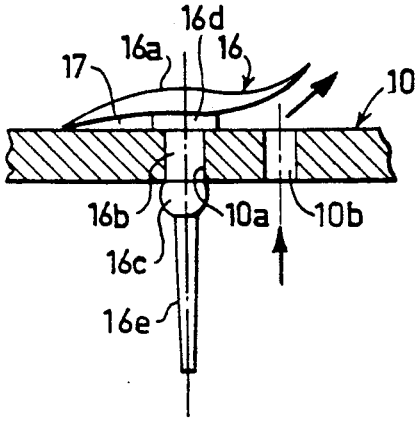
FIG 8a (PRIOR ART)
Figure 9A:
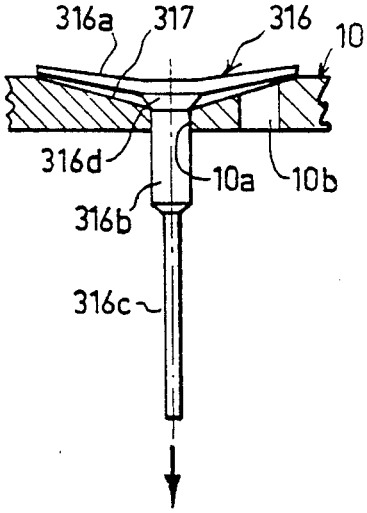
Figure 9B:
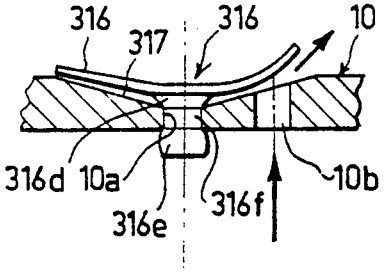

FIGS. 8 and **8*a* illustrate a conventional (prior art) one-way umbrella valve commonly used in fluid pumping devices; whereas FIGS. 9, 9*a* and 9*b* illustrate a novel construction having a number of advantages over the conventional construction. The umbrella valve illustrated in FIGS. 9, 9*a* and 9*b* is identified by the reference number 316 to facilitate its comparison with umbrella valve 16 in FIGS. 8 and 8*a* (and also in FIGS. 3 and 7 for example), but it will be appreciated that the same construction would be used with respect to umbrella valves 20 and 200 illustrated, for example, in FIG. 7**.

With reference first to FIG. 8, it will be seen that the conventional umbrella valve 16 is mounted within a mounting opening **10*a* of the cylinder 10 and includes a dome-shaped umbrella skirt 16*a* for controlling the flow of the air through valve opening 10*b*. The dome-shaped umbrella skirt 16*a* is integrally joined to a valve stem including a neck 16*b* received within the mounting opening 10*a*, and a ball 16*a* for securing the valve within the mounting opening. The conventional valve further includes a juncture section 16*d* of cylindrical configuration between the dome-shaped skirt and the neck 16*b* for producing an annular cavity 17 at the underside of the skirt 16*a* and communicating with the valve opening 10*b* so as to distribute the opening force around the complete undersurface of the skirt. Such a conventional valve is normally applied by passing the stem through the mounting opening 16*b* until the ball 16*c* bears against the underface of the cylinder wall 10. If desired, the end section 16*e* of the stem below the ball 16*c* may then be cut away, thereby leaves the ball bearing against the underface of the cylinder wall 10** to retain the valve.

A disadvantage of such a valve construction, particularly when used in portable fluid pumping devices, is that the valves make the pumping device very noisy. Thus, the dome-shaped umbrella skirt 16*a* requires a very high force to open it, which generates a high pitch noise when the pump is operated at high frequencies, e.g., generally 3,000 rpm and above. Moreover, molding the ball section 16*c* of the valve requires an undercut in the mold and makes extracting the valve from the mold very difficult. Also, inserting the valve in its seat is difficult, and the size of the mounting hole 10*a* is critical.

The novel one-way umbrella valve illustrated in FIGS. 9, 9*a* and 9*b* provides a number of important advantages in the above respects particularly when such a valve is used in a portable fluid pumping device, such as illustrated in FIGS. 1–7.

Thus, the valve illustrated in FIG. 9, therein generally designated 316, also includes a skirt 316*a*, and a stem including a neck 316*b* received within the mounting opening 10*a* of the cylinder wall 10, and an end section 316*c*. In this case, however, the juncture 316*d* between the umbrella skirt 316*a* and neck 316*b* is of frusto-conical configuration, increasing in diameter from the neck to the umbrella skirt. In addition, the umbrella skirt 316*a* is not dome-shaped, as in FIG. 8, but rather is relatively thin and flat for its complete extent. As shown in FIG. 9, in its normal condition it has a relatively flat outer surface, whereas its inner surface is tapered so as to produce a frusto-conical configuration to the skirt 316*a*. However, the conical angle of the skirt is substantially larger that that of the juncture 316*d* between the skirt 316*a* and neck 316*b*.

Moreover, as shown particularly in FIGS. 9*a* and 9*b*, the cylinder wall 10 in which the valve 316 is mounted, is formed with a cavity 317 also of frusto-conical configuration, with the mounting hole 10*a* at the center of the cavity and the valve opening 10*b* adjacent its outer periphery. The conical angle of cavity 317 is smaller than that of the umbrella skirt 316*a*, but larger than that of the juncture section 316*d*.

Such a novel umbrella valve construction provides a number of important advantages over the conventional construction illustrated in FIG. 8. Since the umbrella skirt 316*a* consists of a very thin wall (preferably 0.2–0.3 mm), it requires a lower seating force, has a low natural frequency, and is deflectable through a relatively larger angle with respect to the valve opening than the conventional construction illustrated in FIG. 8. As a result of the thin umbrella skirt and its resultant low mass, which produces a lower natural frequency of the valve, a pump including such valves operates with substantially less noise.

Thus, noise is directly related to the cracking/seating pressure of the valve, i.e., the pressure differential across the valve which is required to overcome the valve closure forces and to open the valve. When a valve with a high cracking pressure opens, it emits a loud noise because of the pressure differential created across its opening. The flow becomes oscillatory, and since these oscillations are at the audible frequencies, the noise is loud. However, because of the thin umbrella skirt and its resultant low mass in the novel valve construction, the natural frequency of the valve is low, and the cracking pressure of the valve is also low, thereby substantially reducing the noise produced during its operation.

In addition, the illustrated valve permits it to be produced and to be assembled more simply and economically than the conventional valve. Thus, the novel valve illustrated in FIG. 9 does not include the ball 16*c* and the skirt undercut in the conventional valve construction (FIG. 8), both of which are difficult to produce by injection molding. In the novel construction (FIG. 9), the skirt undersurface is relatively flat, and the end section 316*c* of the stem joined to the neck 316*b* is of uniform but reduced diameter as compared to that of the neck; preferably, the cross-sectional area of end section 316*c* is less than one-half that of the neck 316*b*.

Such a valve may thus be produced with simpler molds and may be more easily extracted from the molds. Moreover, it can be easily applied to the cylinder wall 10 by passing the neck 16*b* through the mounting opening 10*a* as shown in FIG. 9*a*, and then applying tension to end section 316*c* of the stem to press the umbrella skirt 316*a* against the cavity in wall 10 and to stretch the neck 316*b* until it protrudes substantially through the mounting opening 10, which thereby also reduces the diameter of the neck 316*b*. The stem is stretched as shown in FIG. 9*a* until the end section 316*c* breaks at its juncture with neck 316*b*, whereupon the protruding section of the neck 316*b* contracts in length and increases in diameter to form a bulge, as shown at 316*e* in FIG. 9*b*, for securely retaining the valve in the mounting opening 10*a*. It will also be seen that this construction, and manner of applying the valve, obviate the need for precision in the dimensions of the mounting opening 10*a*.

While the invention has been described with respect to several preferred embodiments, it will be appreciated that other modifications, variations and applications of the invention may be made.

What is claimed is:

1. A one-way umbrella valve for controlling the flow of a fluid through a valve opening in a wall, comprising: a valve stem having a neck received within a mounting opening in said wall, and an umbrella skirt integrally joined to said neck to overlie said valve opening on one side of the wall; the juncture between the umbrella skirt and neck of the valve stem being of frusto-conical configuration increasing in diameter from the neck to the umbrella skirt; said umbrella skirt being relatively thin for its complete extent; said one side of the wall being formed with a cavity of frusto-conical configuration with said mounting opening at the center of the cavity and said valve opening adjacent to the outer periphery of the cavity.

2. The valve according to claim 1, wherein the umbrella skirt has a relatively flat outer surface in its normal condition.

3. The valve according to claim 2, wherein the umbrella skirt has an inner tapered surface which defines, with its flat outer surface, a frusto-conical skirt having a substantially larger conical angle than that of the frusto-conical juncture.

4. The valve according to claim 3, wherein the conical angle of said frusto-conical cavity is smaller than that of said frusto-conical skirt but larger than that of said frusto-conical juncture.

5. The valve according to claim 4, wherein said stem includes an end section joined to its neck and to be severed from its neck after the umbrella valve is applied to said wall; the juncture of said end section of the neck having a cross-sectional area less than one-half that of the neck, such that after the neck is received within said mounting opening in the wall, the main section of the neck may be tensioned to press the umbrella skirt against said one side of the wall over the valve opening, to stretch said neck, and to reduce its diameter until it protrudes substantially through said opening and breaks at its juncture with the end section of the stem, whereupon the protruding portion of the neck contracts in length and increases in diameter to form a bulge for securely retaining the umbrella skirt in said mounting opening with the umbrella skirt tensioned against said one side of the wall.

6. A portable fluid pumping device, comprising:

a pump housing having a fluid inlet port, a fluid outlet port, a passageway between said ports, and a cylinder in said passageway;

a piston reciprocatable within said cylinder through pumping and return strokes;

a valve assembly including a pair of one-way umbrella valves mounted in a wall in said passageway for controlling the flow of a fluid through said valve openings in said wall to produce a positive pressure at one of said ports, and a negative pressure at the other of said ports;

and a drive coupled to said piston for reciprocating it within said cylinder;

each of said umbrella valves comprising: a valve stem having a neck received within a mounting opening in said wall, and an umbrella skirt integrally joined to said neck to overlie said valve opening on one side of the wall; the juncture between the umbrella skirt and neck of the valve stem being of frusto-conical configuration increasing in diameter from the neck to the umbrella skirt;

said umbrella skirt being relatively thin for its complete extent;

said one side of the wall being formed with a cavity of frusto-conical configuration with said mounting opening at the center of the cavity and said valve opening adjacent to the outer periphery of the cavity.

7. The pumping device according to claim 6, wherein the umbrella skirt has a relatively flat outer surface in its normal condition.

8. The pumping device according to claim 7, wherein the umbrella skirt has an inner tapered surface which defines, with its flat outer surface, a frusto-conical skirt having a substantially larger conical angle than that of the frusto-conical juncture.

9. The pumping device according to claim 8, wherein the conical angle of said frusto-conical cavity is smaller than that of said frusto-conical skirt but larger than that of said frusto-conical juncture.

10. The pumping device according to claim 9, wherein said stem includes an end section joined to its neck and to be severed from its neck after the umbrella valve is applied to said wall; the juncture of said end section of the neck having a cross-sectional area less than one-half that of the neck, such that after the neck is received within said mounting opening in the wall, the end section of the neck may be tensioned to press the umbrella skirt against said one side of the wall over the valve opening, to stretch said neck, and to reduce its diameter until it protrudes substantially through said opening and breaks at its juncture with the end section of the stem, whereupon the protruding portion of the neck contracts in length and increases in diameter to form a bulge for securely retaining the umbrella skirt in said mounting opening with the umbrella skirt tensioned against said one side of the wall.

11. A one-way umbrella valve for controlling the flow of a fluid through a valve opening in a wall, comprising: a valve stem having a neck received within a mounting opening in said wall, and an umbrella skirt integrally joined to said neck to overlie said valve opening on one side of the wall; the juncture between the umbrella skirt and neck of the valve stem being of frusto-conical configuration increasing in diameter from the neck to the umbrella skirt;

said umbrella skirt being relatively thin for its complete extent;

said stem including an end section joined to its neck and to be severed from its neck after the umbrella valve is applied to said wall;

the juncture of said end section of the neck having a cross-sectional area less than one-half that of the neck, such that after the neck is received within said mounting opening in the wall, the main section of the neck may be tensioned to press the umbrella skirt being said one side of the wall over the valve opening, to stretch said neck, and to reduce its diameter until it protrudes substantially through said opening and breaks at its juncture with the end section of the stem, whereupon the protruding portion of the neck contracts in length and increases in diameter to form a bulge for securely retaining the umbrella skirt in said mounting opening with the umbrella skirt tensioned against said one side of the wall.

12. The valve according to claim 11, wherein the umbrella skirt has a relatively flat outer surface in its normal condition.

13. The valve according to claim 12, wherein the umbrella skirt has an inner tapered surface which defines, with its flat outer surface, a frusto-conical skirt having a substantially larger conical angle than that of the frusto-conical juncture.

14. The valve according to claim 13, wherein said one side of the wall is formed with a cavity of frusto-conical configuration with said mounting opening at the center of the cavity and said valve opening adjacent to the outer periphery of the cavity, the conical angle of said frusto-conical cavity being smaller than that of said frusto-conical skirt but larger than that of said frusto-conical juncture.

* * * * *